United States Patent [19]

Labarre et al.

[11] Patent Number: 4,993,327

[45] Date of Patent: Feb. 19, 1991

[54] APPARATUS FOR COLLECTIVE TRANSPORTATION OF PASSENGERS, OF METROPOLITAN TYPE WITH AUTOMATIC DRIVE BY INDEPENDENT TRACTION TRUCKS USING PROPULSION NOTABLY BY LINEAR MOTOR

[76] Inventors: Andre Labarre, 6 rue du Mont-Perdu, 31240 - L'Union; Francois Passemard, 53 rue Devic, 31400 Toulouse, both of France

[21] Appl. No.: 370,278

[22] Filed: Jun. 22, 1989

[30] Foreign Application Priority Data

Jun. 27, 1988 [FR] France ..... 88 08618

[51] Int. Cl.[5] ..... B60L 13/00

[52] U.S. Cl. ..... 104/290; 104/291

[58] Field of Search ..... 104/290, 291, 292, 293

[56] References Cited

U.S. PATENT DOCUMENTS 4,061,089 12/1977 Sawyer ..... 104/292 X 4,793,263 12/1988 Basic et al. ..... 104/293 X

FOREIGN PATENT DOCUMENTS 0027117 3/1979 Japan ..... 104/291

*Primary Examiner*—Joseph F. Peters, Jr.

*Assistant Examiner*—Virna Lissi Mojica

*Attorney, Agent, or Firm*—Lackenbach, Siegel Marzullo & Aronson

[57] ABSTRACT

The present invention concerns an apparatus for collective transportation of passengers, of metropolitan type with automatic drive by independent traction trucks using notably propulsion by linear motor, in this apparatus, the cabins (1) are driven by independent trucks (3) running on a track (7) parallel to the cabin track (5), these trucks being coupled in relatively loose or flexible connection to the cabins in order that their path will not be affected by that of the cabins and vice versa.

15 Claims, 5 Drawing Sheets

APPARATUS FOR COLLECTIVE TRANSPORTATION OF PASSENGERS, OF METROPOLITAN TYPE WITH AUTOMATIC DRIVE BY INDEPENDENT TRACTION TRUCKS USING PROPULSION NOTABLY BY LINEAR MOTOR

The present invention relates to an apparatus for collective transportation of passengers, of metropolitan type with automatic drive by independent traction trucks, which is perfectly suitable in particular for propulsion by linear electric motor.

It is known that one of the greatest problems of propulsion by linear electric motor is to maintain as constant as possible an air gap between inductor and armature in the course of the movement of the motor in order to keep its performance and reliability optimal.

The invention aims to solve this problem in metropolitan transportation locomotion by using traction trucks with linear motor which are attached in flexible connection to the passenger cabins and are guided independently of the latter, so that the inevitable oscillations of the cabins due for example to movement of the passengers and of the track are not transmitted to the traction trucks and therefore do not adversely affect the operation of the linear motor.

The object of the invention is in effect an apparatus for collective transportation of passengers, of metropolitan type with automatic drive of passenger cabins, characterized in that the cabins are driven by independent trucks rolling on a track parallel to the cabin track, therefore trucks being coupled to the cabins in relatively loose or flexible connection so that their path will not be affected by that of the cabins and vice versa.

These traction trucks are advantageously disposed under the cabins and guided on an underlying track contiguous to the passenger cabin track and in the same longitudinal median plane. This solution has the advantage of not increasing the general outside dimensions of the cabins while profiting from the general infrastructure of the main track of the passenger cabins.

The traction trucks may also be guided suspended above the cabins on their track.

As mentioned before, this solution of drive by traction trucks on an independent track is directly suited for propulsion by linear motor and in particular for the U-shaped linear motor, whose efficiency is very attractive but whose air gap must be held to perfectly.

Also, it is preferred to dispose the inductor elements of the motor on the truck track, in a central position thereof, and the armature elements on the trucks, these elements capping the inductor rail on the top.

Naturally, inductor elements may be disposed at regular or irregular intervals on the truck tracks as a function of the power to be transmitted, but at any rate, at least one inductor element must be disposed over the length of the armature of the truck, or over the length of the truck if the armature extends over the full length of the truck.

As the trucks are substantially linear, it is also necessary to limit their length as a function of the track configuration and in particular as a function of the smallest turn radius of the track. It will thus be possible to couple several traction trucks end to end, for example two or three per cabin over its length.

The guiding of the trucks on their track occurs preferably by wheels or rollers and counter-rollers with air tires rolling over the smooth, continuous, suitably shaped wall of the track. The guiding is, on the one hand, vertical for the vertical support of the truck, and on the other hand, transverse to keep the lateral air gap of the linear motor constant.

The passenger cabins are advantageously carried and guided on their track by air cushions normally arranged under their base and laterally on their lower periphery, the corresponding, preferably metal track being provided over its width with two flat portions, of equal width, normally horizontal and spaced from each other by a constant distance for the passage of the elements for connecting the truck to the cabin, and laterally with two vertical strips or edges of equal height assuring the transverse guiding of the lateral air cushions of the cabin.

This design avoids the use of the classic cabin-supporting bogies and chassis, which are heavy. At the same time, the guiding by vertical and horizontal air cushions permits proper distribution of the loads and stresses over the entire cabin, thus relieving their structure, and it further avoids any noise and vibration caused by the classic rolling type guiding of the cabins.

With the objective of achieving optimum comfort of the passengers, the compressors for the air cushions have been placed on the traction trucks in order to prevent the respective operational vibrations from getting to the cabins. These vibrations can naturally be absorbed by the mass of the truck track, advantageously made of concrete, formed with a rectangular tubular section ("profile") embracing said trucks and having the inductor elements on its base and at a median level, and at right angles to this rail a longitudinal upper opening for passage of said elements for connecting the trucks to the cabins. This track can be formed from two horizontal U-shaped portions opposite each other and connected by a central cross member which serves as central track-making gauge, the truck track cage serving as support beam for the cabin track.

On the truck track, an electrified line can be disposed in the free space for power supply to the trucks and hence to the cabins, to be realized by articulated current collector contact integral with the trucks. This truck track can serve at the same time as control element of the movement of the cabins as needed, the movement control being managed from a processing unit of the recorded signals and destination and corresponding pickups (sensors) disposed on this track.

As the processing of the transportation occurs automatically, it will be carried out preferably by small units and in particular cabin by cabin, which makes it possible to switch the cabins at certain points onto the different tracks of a meshed urban network. Thus there can be a complete rotation of a line segment with the two tracks carrying the trucks and corresponding cabins, as well as a translational displacement of this segment, or a single cabin can be displaced in translation or lateral shifting, in view of its low weight, onto a track running parallel or onto a storage or maintenance area.

The coupling of the trucks to the passenger cabins is done in the classic manner by a retractable current collector with a vertical lug for mechanical hooking to the cabin, a vertically insertable sleeve for supplying the air cushions of the cabin with compressed air: a self-connecting power supply plug for the functions to be maintained inside the cabin, for example the lighting, and lastly a plug for the telecommunication signals, video monitoring and any transmissions.

Naturally, the recess formed on the cabin base and receiving the hooking lug is appropriately made with sufficient clearance in width and depth to allow the cabin to move freely without letting its small vertical and transverse oscillations affect the actual path of the truck and hence the air gap of the linear motor.

Lastly, it should be noted that as the essentially flat and inert nature of the cabin track bares only a central longitudinal opening, without possible access to the truck track, the passengers can be evacuated over this track in case of a breakdown. It suffices to provide emergency doors at the end panels of the cabins and protective barriers or railings raising the vertical guide bands onto the cabin track.

The invention is illustrated below with the aid of examples of realization and referring to the annexed drawings in which.

Figure 1:
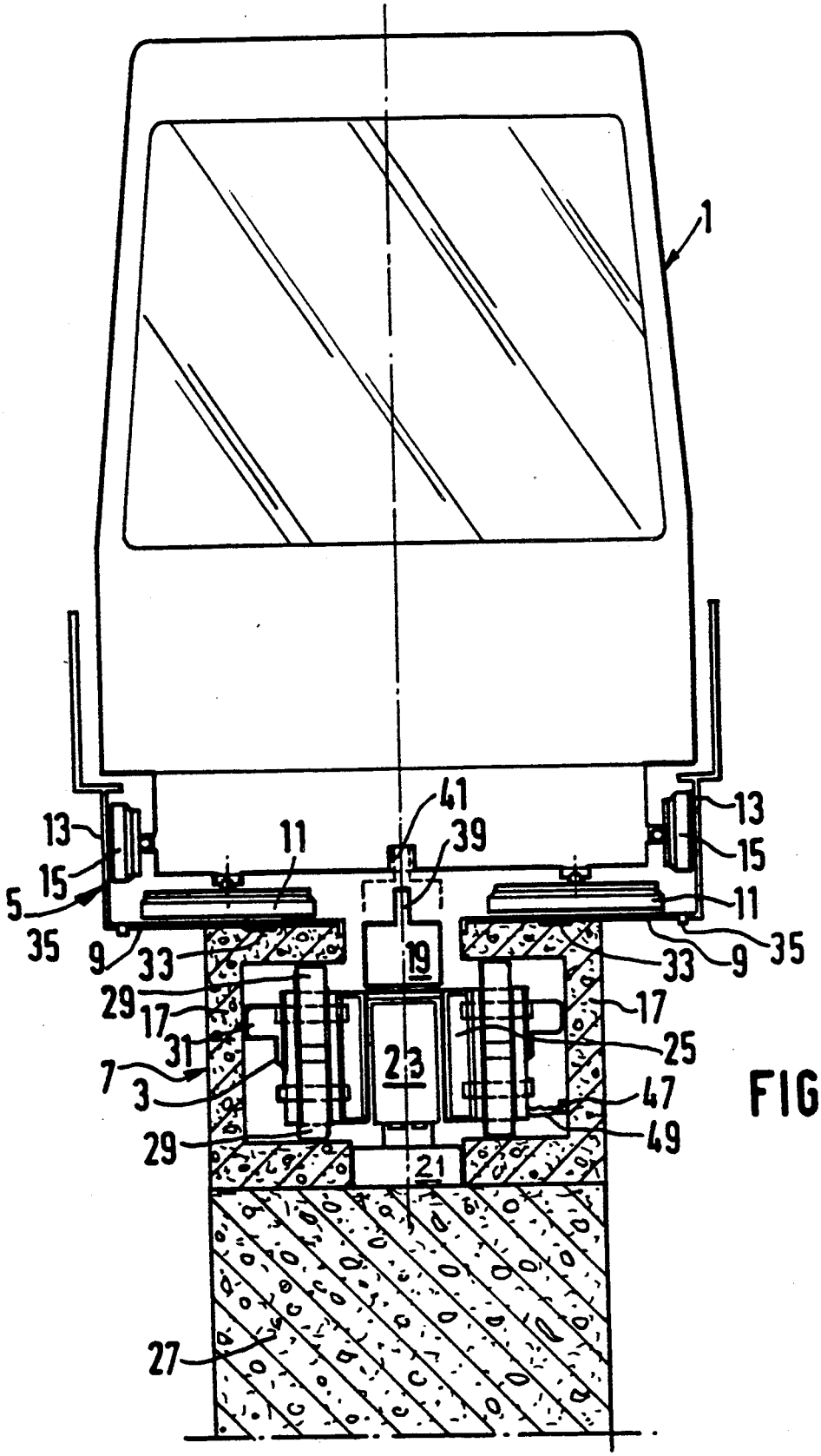
FIG. 1 is a view in transverse section of a transportation apparatus according to the invention.
Figure 2:
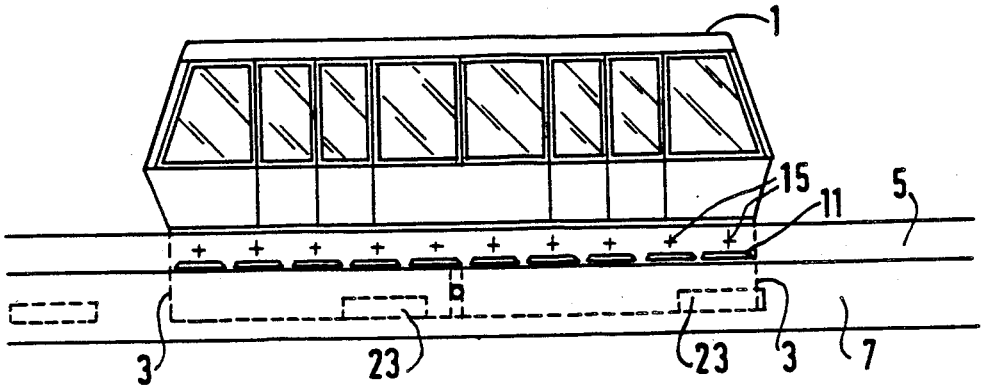
FIG. 2 is a schematic view of the apparatus on its tracks.
Figure 3:
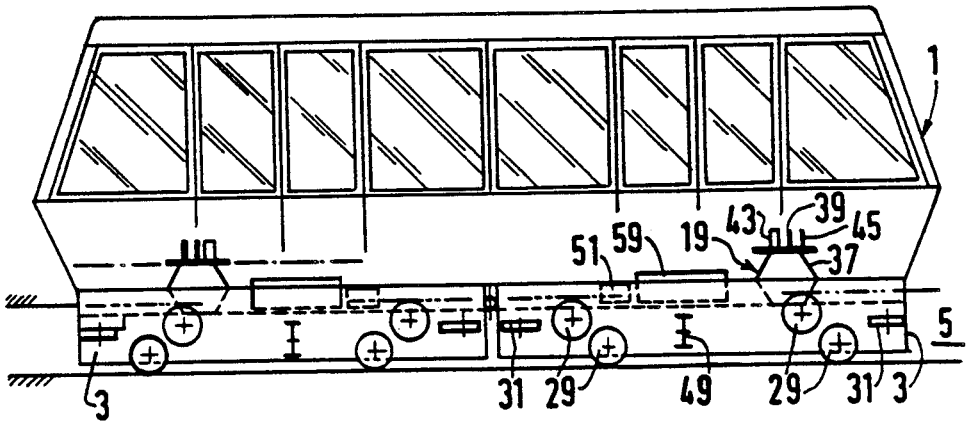
FIG. 3 is a schematic view in elevation of the trucks under a cabin showing their main elements.
Figure 4:
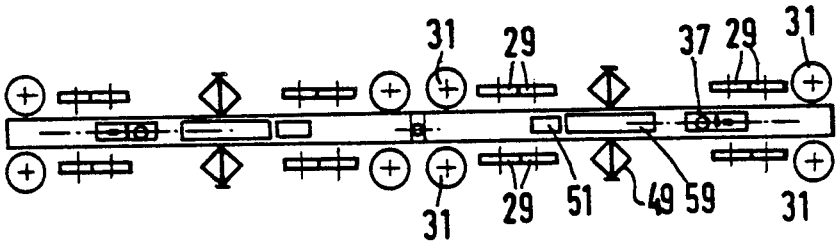
FIG. 4 is a schematic top view of these trucks.

As represented in FIGS. 1 to 4, the apparatus for collective transportation of passengers according to the invention consists of the assembly of a passenger cabin 1 and of two underlying articulated traction trucks 3 coupled to this cabin, and of corresponding adjacent tracks 5 and 7. The cabin is guided by air cushions on the upper track 5, while the trucks are rollingly guided inside the lower track 7, these tracks being contiguous to each other in the same longitudinal median plane.

The cabin track is of metal, made of two flat, substantially horizontal bands 9 for the supporting guiding of the cabin by air cushions 11, and of vertical lateral edges 13 for the lateral guiding of the cabin, which is also done by air cushions 15 normally ("regularly") disposed on the lower lateral periphery of the cabin. It should be noted that a lateral guiding by rolling might also be used. Furthermore, de-icing elements 33 are disposed under the horizontal metal bands 9, as well as slightly sloping rain water draining elements 35, to make the track weatherproof.

The truck track 7 is of tubular form of rectangular cross-section, composed of two U-shaped portions 17 and open on its upper face for passage of the elements 19 for connecting the trucks to the cabin. It carries a central cross member 21 which serves as element for attachment to the U-shaped portions and which includes the inductor elements 23 of the linear motor driving the trucks; these trucks each carry over their length the U-shaped armature element 25 capping said inductor rail at the top. The tracks are shown in an aerial version carried by poles 27, the lower track serving as support beam for the cabin track. The trucks 3 are rollingly guided in their track by means of vertical wheels and counter-wheels 29 and horizontal wheels 31 applying against the walls of the track. This guiding is very precise and permits keeping the necessary constant air gap between inductor and armature.

This independent guiding of the trucks on their track is made possible owing to the flexible mechanical connecting between the trucks and the cabin. This connection is obtained by means of a vertical current collector 37 by the cooperation of a vertical lug 39 in a corresponding recess 41 in the base of the cabin, sufficient clearance being provided between the lug and the corresponding recess so that the cabin oscillations are not transmitted to the trucks. The current collector 37 mounted at the upper part of each of the trucks is retractable and permits the trucks to detach from the cabins. This current collector carries the other connecting elements, which are automatically connected to the cabin when the current collector is lifted, such as an attachable sleeve 43 for supply of compressed air to the cabin from compressors 59 mounted on the trucks as well as a vertically self-connecting plug 45 for power supply to the cabin. The truck track carries an electrified line 47 for general power supply of the system taken off on each of the trucks by a second horizontal current collector 49.

Also there have been mounted on the trucks a storage battery (not shown) capable of assuring a minimum power supply to the cabins in case of breakdown and a small auxiliary motor 51 to permit restarting the trucks in case of failure of one of the inductors 23; these inductors are located on the central cross member 21 and normally spaced from each other by a distance approximately equivalent to the length of a truck. Over the length of a cabin, therefore, there are two inductors, as FIG. 2 indicates. In fact, the spacing of the inductors is determined depending on the power to be transmitted, and it is smaller when standing, where acceleration/deceleration must be high. It should be noted also that this control of the movement is operated from position sensors on the truck track which permit the movement of the trucks to be adapted to the demand.

Figure 5:
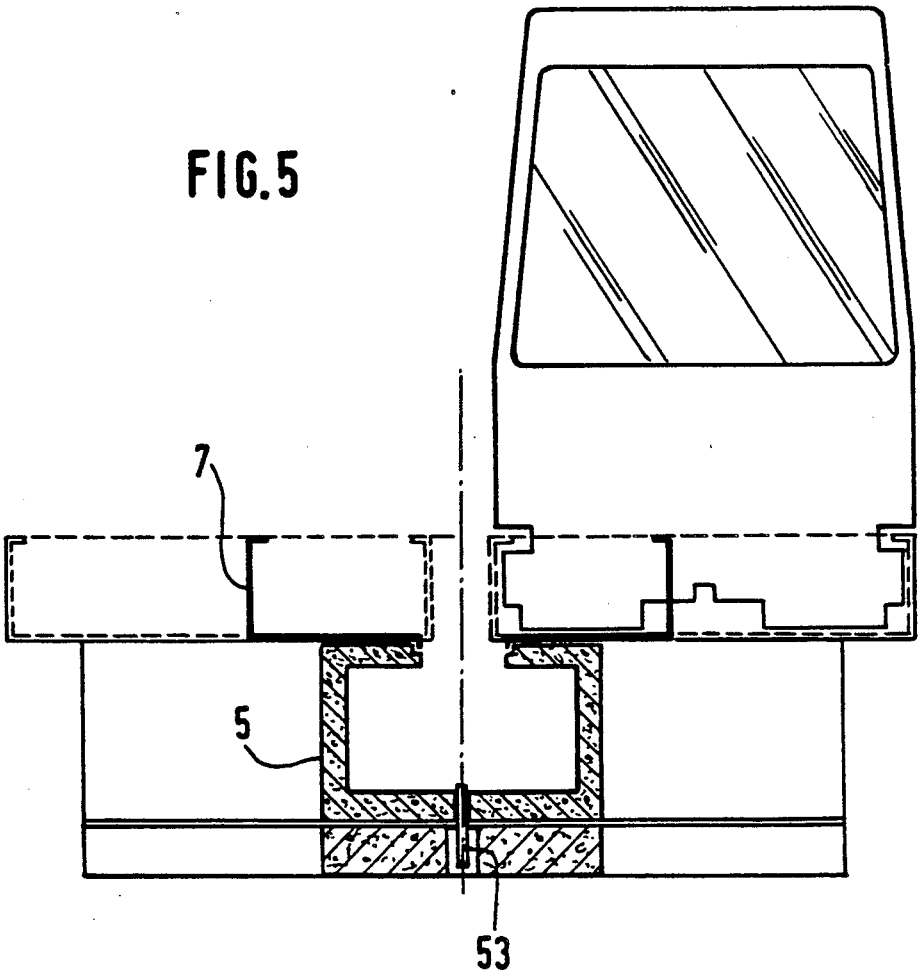
FIGS. 5, 6 and 7 show, respectively, the possibilities of track switching and cabin shifting.
Figure 7:
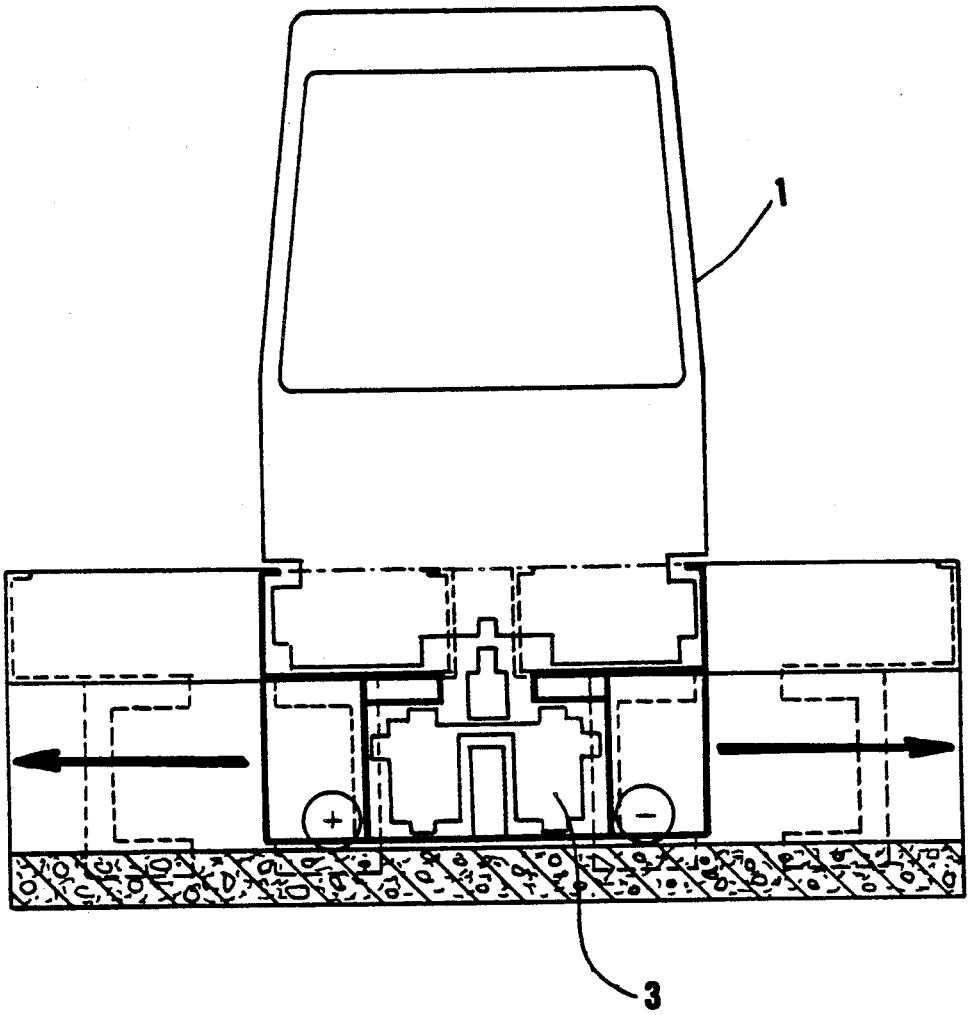

In addition, as mentioned before, the track may have removable switching elements. FIG. 5 shows a removable line segment by central fulcrum 53 permitting the simultaneous rotation of the trucks and of the cabin for angularly connecting with another line portion of a network. Optionally the fulcrum may be displaced in translation, for example by a jack, to position the cabin and the trucks (FIG. 7) on a parallel track or at the end of the track on a return line.

Figure 6:
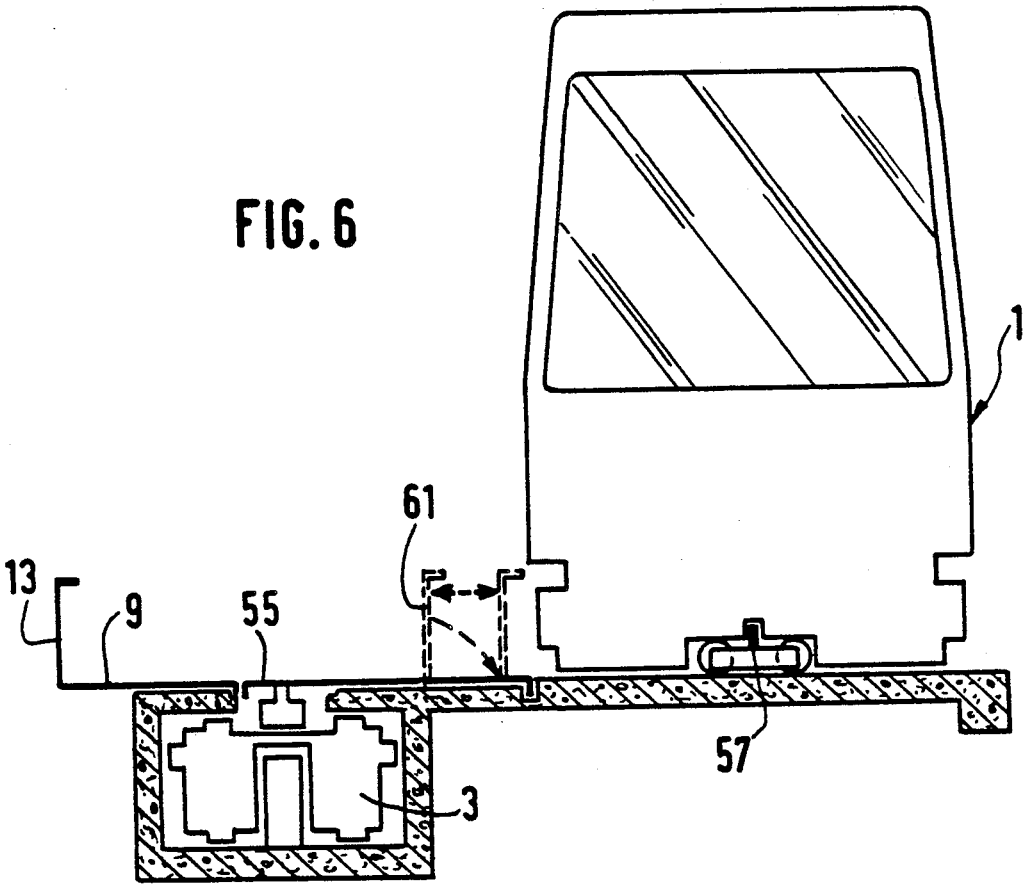

FIG. 6 shows the case of shifting a cabin alone, used for example to park the cabin. For this it suffices to provide, on a portion of line, a flat slide 55 which closes the central opening of the cabin track and thus permits its rolling by a median roller truck 57, and the respective flapping down of one of the track edges 61. This transfer is made possible owing to the light weight of the cabins.

Numerous variants are within the scope of the invention. Thus, instead of providing trucks under the cabins, they may be suspended above, along an upper track parallel to the cabin-supporting track. In this case the trucks are coupled to the upper part of the cabin, but are still guided independently thereof. Coupling the trucks laterally on the cabins on an adjacent track can also be envisaged.

Instead of providing a lateral guiding of the cabins by air cushions around a cabin, there may of course be used a guiding by wheels applying against the opposite edges of the track. The support of the cabins by bearing may also be envisaged.

Besides, the locomotion is not limited to the linear motor and other sources of propulsion may be used.

Although it has been shown in an aerial version, the apparatus is also very advantageously suitable for underground installation because of the general oval form of the assembly of cabin and lower trucks.

Lastly, there is no obstacle to the simultaneous traction of several cabins coupled together as a train.

We claim:

1. Apparatus for collective transportation of passengers with automatic drive of passenger cabins (1), characterized in that the cabins (1) are driven by independent trucks (3) moving over a track (7) parallel to the cabin track (5), these trucks being coupled in relatively loose or flexible connection to the cabins so that their path will not be affected by that of the cabins and vice versa, said trucks (3) being disposed under the cabins (1) and in their median plane, guided on an underlying track (7) contiguous to the cabin track (5), and said trucks (3) being connected to the cabins (1) by means of a retractable current collector (37) carrying the coupling element (39) between cabins and trucks.

2. Transport apparatus according to claim 1, characterized in that it includes elements for switching at end of line or for angularly connecting another line, such as elements mounted on a fulcrum (53) to rotate a segment of the line with the trucks and cabins, or an element for complete translation of a segment of the line with the trucks and cabins.

3. Transport apparatus according to claim 1, characterized in that the cabin track includes a retractable central slide (55) on a segment of line and a lateral edge (61) to be flapped down horizontally, thereby permitting the lateral translation of a cabin by rolling onto a storage or maintenance area.

4. Transport apparatus according to claim 1, characterized in that the cabin track (7) includes lateral railings making safe the evacuation of the passengers thereon in case of breakdown of the system.

5. Transport apparatus according to claim 1, characterized in that the traction trucks (3) operate as linear motor on their track.

6. Transport apparatus according to claim 5, characterized in that said linear motor has a U-shaped air gap, said track carrying at its center inductor elements (23) and the trucks carrying the corresponding armature elements (25) around said rail.

7. Transport apparatus according to claim 6, characterized in that the inductor elements (23) are spaced by a distance at most equal to the length of the armature (25) of the truck.

8. Transport apparatus according to claim 1, characterized in that several trucks (3) are coupled over the length of a cabin (1).

9. Transport apparatus according to claim 1, characterized in that the trucks (3) are rollingly guided vertically and laterally in a track, by rollers or wheels and counter-rollers (29, 31) bearing against the wall of their track.

10. Transport apparatus according to claim 1, characterized in that the truck track (7) is formed with a tubular section of rectangular cross-section enclosing said trucks (3), having on its base and at a median level said inductor elements (23) and at right angles to this rail an upper median longitudinal opening for the passage of said elements (19) for connection of the trucks to the cabins.

11. Transport apparatus according to claim 10, characterized in that the truck track (7) consists of two opposite U-shaped portions (17), of concrete, connected by a central cross member (21) which serves as assembly gauge.

12. Transport apparatus according to claim 1, characterized in that the truck track (7) has an electrified line (47) for general power supply taken off laterally by a current collector (49) integral with the trucks for supplying power to the trucks and to its accessories as well as of the passenger cabins, and sensor elements for control of the movement of the trucks.

13. Transport apparatus according to claim 1, characterized in that the cabins (1) are guided on their track (5) by air cushions (11, 15) vertically and laterally, respectively.

14. Transport apparatus according to claim 13, characterized in that the cabin track (5) is of metal, comprising too main bands (9) over its width and two vertical edges (13) on its sides, a de-icing system (33) and water draining elements (35) are provided as well.

15. Transport apparatus according to claim 14, characterized in that the cabin track (5) is carried by the truck track (7), secured on the upper portion of the latter.

* * * * *